US008303059B2

(12) United States Patent
Darney

(10) Patent No.: US 8,303,059 B2
(45) Date of Patent: Nov. 6, 2012

(54) DOMESTIC APPLIANCE WITH CONCEALED HINGE

(75) Inventor: Ian Darney, Cardiff (GB)

(73) Assignee: Panasonic Manufacturing U.K. Ltd. (GB)

( * ) Notice: Subject to any disclaimer, the term of this patent is extended or adjusted under 35 U.S.C. 154(b) by 898 days.

(21) Appl. No.: 12/305,968

(22) PCT Filed: Jun. 22, 2007

(86) PCT No.: PCT/EP2007/005543
§ 371 (c)(1),
(2), (4) Date: Dec. 21, 2008

(87) PCT Pub. No.: WO2007/147626
PCT Pub. Date: Dec. 27, 2007

(65) Prior Publication Data

US 2012/0025686 A1 Feb. 2, 2012

(30) Foreign Application Priority Data

Jun. 22, 2006 (GB) ..... 0612358.2

(51) Int. Cl.
*A47B 96/04* (2006.01)

(52) U.S. Cl. ..... 312/405; 312/329

(58) Field of Classification Search ..... 312/405, 312/326–329; 16/358–361, 364, 260, 262, 16/264; 49/386
See application file for complete search history.

(56) References Cited

U.S. PATENT DOCUMENTS 1,075,130 A * 10/1913 Streberger ..... 16/358
2,867,839 A 1/1959 Squire
3,065,498 A 11/1962 Johnson
4,485,524 A * 12/1984 Neville ..... 16/241
4,953,259 A * 9/1990 Frye et al. ..... 16/225
5,113,628 A * 5/1992 Richardson et al. ..... 52/171.3
5,172,969 A * 12/1992 Reuter et al. ..... 312/328
5,265,954 A * 11/1993 Keil ..... 312/405
(Continued)

FOREIGN PATENT DOCUMENTS

DE 3530199 A1 5/1986
(Continued)

OTHER PUBLICATIONS

International Search Report and Written Opinion dated Oct. 1, 2008, for International Application No. PCT/EP2007/005543.

(Continued)

*Primary Examiner* — Hanh V Tran
(74) *Attorney, Agent, or Firm* — Myers Bigel Sibley & Sajovec

(57) ABSTRACT

A domestic appliance for built-in installation, comprising: a housing having at least two sides; a front door; a hinge mechanism, provided at or adjacent one of the sides, coupling the door to the housing and permitting relative movement thereof, wherein the door is movable between a first position, in which the door is closed, and a second position, in which the door is fully open; and/or wherein the hinge is so shaped and dimensioned whereby, in use, the extent of protrusion of the door laterally beyond said one side when the door is in said second position is less than or equal to that when the door is in said first position. Preferably, the hinge mechanism is shaped and arranged whereby double movement, for example both rotational and translational movement, of the door relative to the housing is facilitated during movement between said first position and said second position.

27 Claims, 5 Drawing Sheets

U.S. PATENT DOCUMENTS

| | | | | |
|---|---|---|---|---|
| 5,931,554 | A * | 8/1999 | Koopman | 312/405 |
| 6,493,906 | B2 * | 12/2002 | Matteau | 16/358 |
| 6,945,621 | B2 * | 9/2005 | Shin | 312/405 |
| 6,978,516 | B1 * | 12/2005 | Calderon et al. | 16/235 |
| 7,192,104 | B2 * | 3/2007 | Tarantik | 312/405 |

FOREIGN PATENT DOCUMENTS

| | | | |
|---|---|---|---|
| DE | 20 2005 014 379 | U1 | 12/2005 |
| EP | 0657609 | A1 | 12/1993 |
| EP | 0823830 | A1 | 2/1998 |
| EP | 1327841 | B1 | 10/2002 |
| EP | 1327841 | A2 | 7/2003 |
| FR | 2057278 | A | 5/1971 |
| FR | 2348633 | A7 | 11/1977 |
| GB | 2274677 | A | 8/1994 |
| WO | WO 2007/147626 | A1 | 12/2007 |

OTHER PUBLICATIONS

International Preliminary Report on Patentability dated Jul. 4, 2008, for International Application No. PCT/EP2007/005543.

International Search Report issued in the parallel GB case (GB0612358.2) dated Oct. 5, 2006.

* cited by examiner

DOMESTIC APPLIANCE WITH CONCEALED HINGE

BACKGROUND OF THE INVENTION

1. Field of the Invention

The present invention relates to domestic appliances, and more particularly to domestic appliances with special-purpose door-hinging mechanisms.

2. Discussion of the Related Art

Published UK patent application GB2410059A discloses domestic electrical appliance such as a refrigerator or microwave oven, with a door that is laterally hinged between a lower supporting hinge and an upper hinge. The upper hinge comprises an angled bracket with a projecting portion and the upper edge of the door is provided with a ramp-shaped slide block that progressively interferes with the projecting portion when the door is opened to angles greater than a predetermined value exerting an increasing resistant torque as the angle of opening increases. The door may be opened beyond, for example, 130-140 degrees.

A problem is that, with a growing requirement for microwave ovens and other domestic appliances to be installed "built-in" to furniture, e.g. in fitted kitchens, appliances designed for free standing situations, such as the appliances in the aforementioned GB2410059, with the door opening 130+ degrees, cause difficulties in mounting and are unsatisfactory. For example, it can be difficult or impossible to have appliances such as microwave ovens flush fitting within kitchen furnishing, without unsightly gaps around the sides or other extremities.

FIG. 1 (PRIOR ART) shows conventional domestic appliance including a hinged front door, as is known from GB2410059A. Here, the appliance is a refrigerator comprising a cabinet 1 and including a door 3 hinged vertically on one side (and shown in the open position).

Door 3 is hinged to the cabinet by means of an upper hinge unit and a lower hinge unit. The upper hinge unit generally comprises a right-angled bracket 9 attached to the front upper edge of cabinet 1 with screws so that it projects.

The projecting portion of right-angled member 9 overlaps upper edge 5 of the door and is provided with a vertical pin 10 that is inserted into a cylindrical seat formed in the upper edge 5 of door 3. The structure of the lower hinge unit is wholly similar. Bracket 11 is also provided with a vertical pin, which is not visible, which is inserted into a cylindrical seat formed in the lower edge of the door. The two brackets 9, 11 and corresponding pins like 10 form end hinges on which the door hinges.

FIG. 2 (PRIOR ART) illustrates the mounting of a microwave oven 202 in a rectangular kitchen compartment 204 of the built-in kitchen type, using prior art techniques. In order to accommodate the action of the hinge at the left side 206 of the oven 202, and the position of the nearest edge 208 of the door 210 (only part of which is shown) when the latter is open, it is necessary to have spacing 212 (shown by hatching, and exaggerated somewhat for the purpose of illustration) between the side 206 (the furthermost lateral extent of the oven 202 when the door 210 is closed) and the left side 214 of the compartment 204. A problem is that, with such a spacing 212, it may be necessary to use some additional bracket or spacer(s) (not shown), in order to retain the oven 202 in a fixed, stable position within the compartment. A further problem is that spacing 212 may become a trap for small objects and an area within a kitchen that is very difficult to clean.

SUMMARY OF THE INVENTION

The present invention provides a domestic appliance for built-in installation, comprising: a housing having at least two sides; a front door; a hinge mechanism, provided at or adjacent one of the sides, coupling the door to the housing and permitting relative movement thereof, wherein the door is movable between a first position, in which the door is closed, and a second position, in which the door is fully open; wherein the hinge mechanism is attached to the door and to the housing at points spaced apart from the vertical extremities thereof, whereby, when the door is in said first position, the hinge mechanism is not visible from a position in front of the appliance. Preferably, the hinge is so shaped and dimensioned whereby, in use, the extent of protrusion of the door laterally beyond said one side when the door is in said second position is less than or equal to that when the door is in said first position.

According to another aspect of the invention, there is provided a domestic appliance for built-in or slot-in installation, comprising: a housing having at least two sides; a front door; a hinge mechanism, provided at or adjacent one of the sides, coupling the door to the housing and permitting relative movement thereof, wherein the door is movable between a first position, in which the door is closed, and a second position, in which the door is fully open; wherein the hinge mechanism is so shaped and dimensioned whereby, in use, the extent of protrusion of the door laterally beyond said one side when the door is in said second position is less than or equal to that when the door is in said first position. Preferably, the hinge mechanism is attached to the door and to the housing at points spaced apart from the vertical extremities thereof, whereby, when the door is in said first position, the hinge mechanism is not visible from a position in front of the appliance.

Preferably, the hinge mechanism is so shaped and dimensioned such that, during movement of the door between said first position and said second position, the door moves laterally outwards then inwards, whereby the extent of protrusion of the door laterally beyond said one side is temporarily greater, by a small distance, than that when the door is in said first position. Preferably, the small distance is up to 3 mm, and more preferably 2-3 mm.

The hinge mechanism may be shaped and arranged whereby double movement, for example both rotational and translational movement, of the door relative to the housing is facilitated during movement between said first position and said second position.

Preferably, the hinge mechanism comprises, at least each of the top and bottom of the housing: a first hinge member, fixedly attached to the door and having a primary slot defined therein. Preferably, the first hinge member is spaced apart from both the top and bottom of the door.

Preferably, the hinge mechanism comprises, at least each of the top and bottom of the housing: a second hinge member, fixedly attached to the housing and having a secondary slot defined therein. Preferably, the second hinge member is spaced apart from both the top and bottom of the housing.

Preferably, the hinge mechanism further comprises, at least each of the top and bottom of the housing: a pair of connecting members, each connecting member coupling the first and second hinge members together via a respective slot, wherein each slot permits movement of a different type, of the first hinge member relative to the second hinge member.

Preferably, the primary slot comprises a relatively elongate slot and the secondary slot comprises a relatively short slot, or the primary slot comprises a relatively short slot and the secondary slot comprises a relatively elongate slot. Preferably, wherein the elongate slot is generally arcuate or generally curvilinear, thereby facilitating substantially rotational movement of the door relative to the housing during movement between said first position and said second position. Preferably, wherein the short slot extends in a linear manner, thereby facilitating substantially linear translational movement of the door relative to the housing during movement between said first position and said second position. Preferably, the short slot extends in a direction at an angle ("slot angle") to the line joining the endpoints of the elongate slot, the angle being for example approx. 45 degrees. However, this is one example of a possible configuration; the arrangement may be such that the aforementioned slot angle is up to 90 degrees or up to 180 degrees.

Suitably, each of the hinge members is in the form of a plate, for example made of steel. However, it will be appreciated by skilled persons that many alternative materials may be used, including many metals, subject to stress tolerance requirements. Alternatively, the hinge members may be in the form of blocks rather than plates, and/or may be a plastic molded part.

The primary slot, the secondary slot, or both may have provided on the internal surface thereof a raised portion extending along the length of the slot, for engagement with a corresponding recessed shape in a respective coupling member. Alternatively, the slots may have flat inner surfaces.

The connecting member may comprise pins, nuts and bolts or. However, it will be appreciated by skilled persons that many alternative fixing means may be used.

The door may include a foremost, generally rectangular, glass plate; wherein the furthest lateral extent of the door is defined by the edge of the glass plate and the front facing surface of the glass plate when the door is in said first and second positions, respectively. Alternatively, the plate may be formed of perspex, PMMA, or some other suitable material with similar properties to the aforementioned materials. Alternatively, the plate may be wholly or partially made of metal, e.g. stainless steel or aluminium.

In an alternative configuration, instead of being provided at or adjacent one of the sides of the housing, the hinge mechanism is provided at or adjacent the top or bottom of the housing.

Suitably, the domestic appliance is a microwave oven. However, it will be appreciated by skilled persons that the appliance may take many alternative forms, which devices may be ovens incorporating one or more of the following cooking techniques: convection, microwave, steam, grill, and so forth. Alternatively, the appliance is a fridge, freezer, or other domestic appliance with a door.

Using techniques according to the invention, appliances such as microwave ovens can be flush fitted into rectangular apertures such as found in fitted kitchen furnishing, leaving no problematic unsightly gaps at the sides or elsewhere.

The invention enables the appliance to define the same rectangular profile or spatial requirement irrespective of whether the door is open or closed.

Thus the invention enhances the built-in or "slot-in" mounting of domestic appliances.

BRIEF DESCRIPTION OF THE DRAWINGS

Embodiments of the invention will now be described in detail, by way of example, with reference to the accompanying drawings, in which.

In the description and drawings, like numerals are used to designate like elements.

DETAILED DESCRIPTION OF THE PREFERRED EMBODIMENTS

Figure 1:
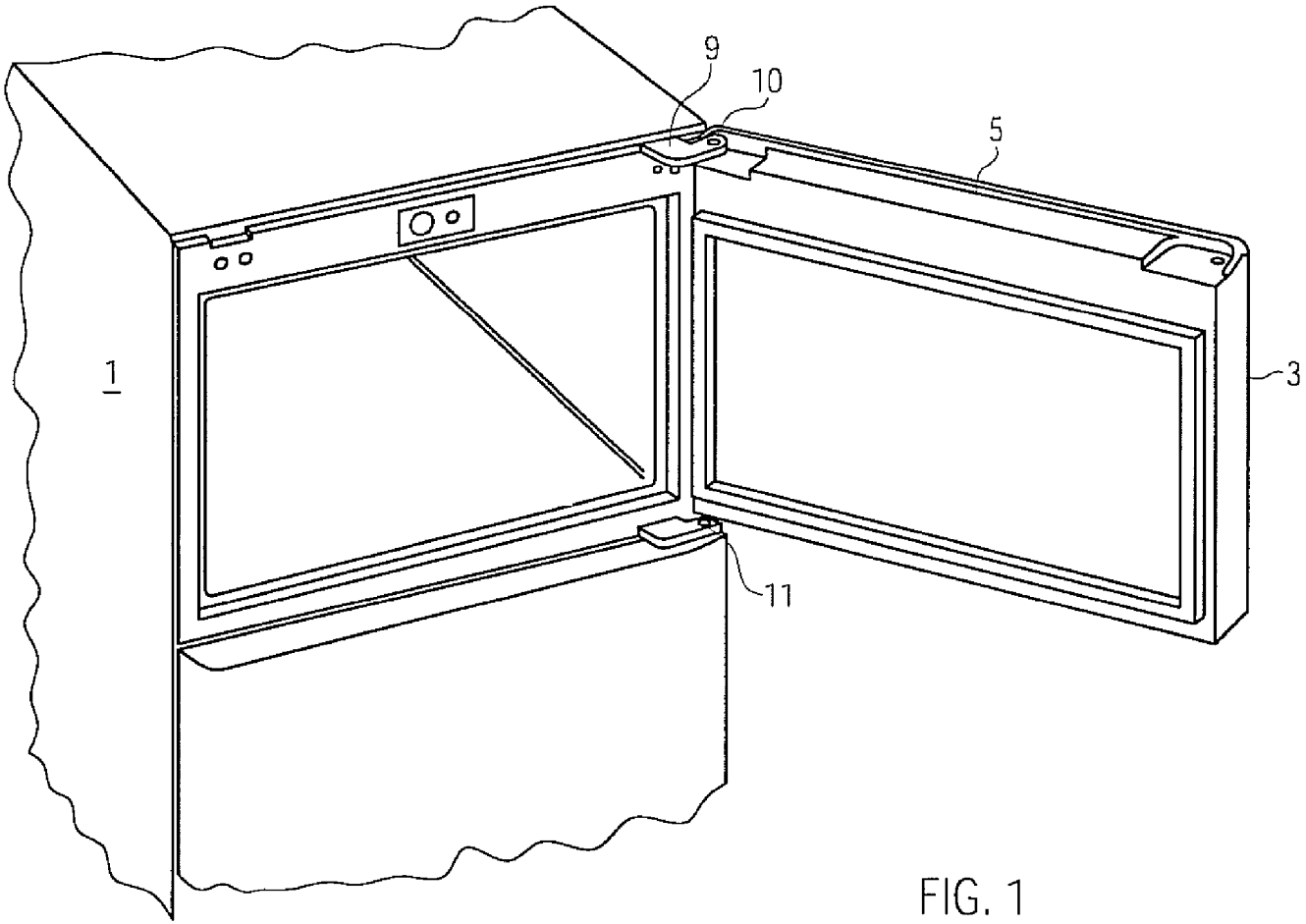
FIG. 1 (prior art)
FIG. 1 (PRIOR ART) shows conventional domestic appliance including a hinged front door.
Figure 2:
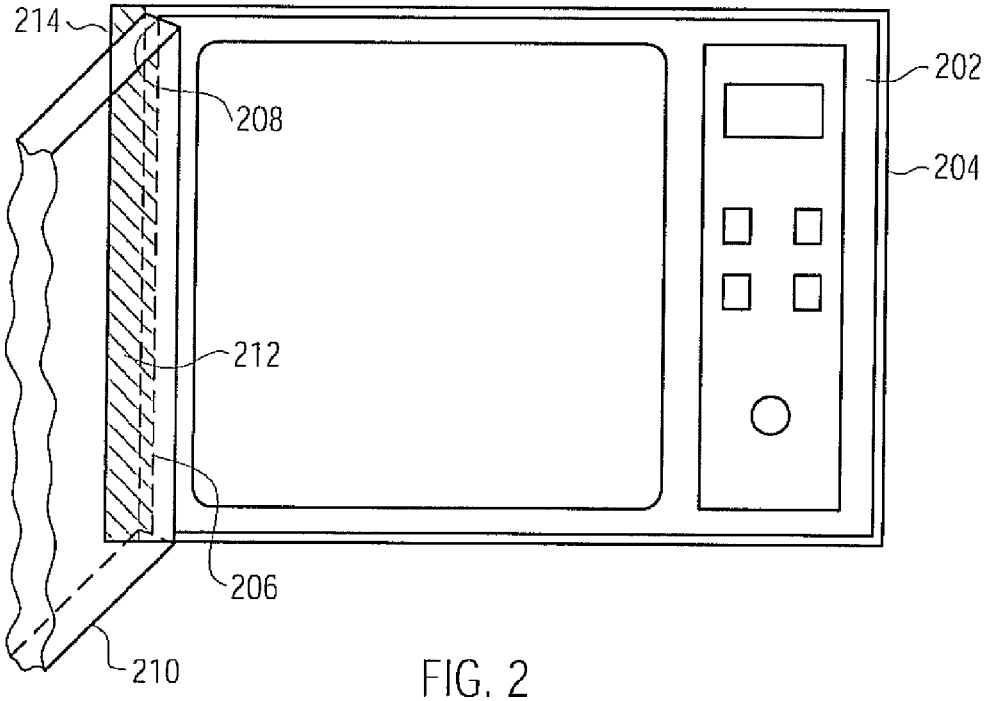
FIG. 2 (prior art)
FIG. 2 (PRIOR ART) illustrates the mounting of a microwave oven in a kitchen compartment, using prior art techniques.

This invention concerns domestic appliances having a hinged door, such as ovens, fridges, freezers and the like. The invention is, for example, particularly beneficial in relation to microwave ovens. However, the invention is applicable to domestic appliances that may be freestanding, but is advantageous for such devices that are adapted for built-in installation, i.e. they are to be installed within a framework or outer housing, or are mounted with kitchen or other household furniture (sometimes known as "slot-in" or "built-in" appliances).

The present invention provides a domestic appliance for built-in installation, comprising: a housing having at least two sides; a front door; a hinge mechanism, provided at or adjacent one of the sides, coupling the door to the housing and permitting relative movement thereof, wherein the door is movable between a first position, in which the door is closed, and a second position, in which the door is fully open; wherein the hinge mechanism is attached to the door and to the housing at points spaced apart from the vertical extremities thereof, whereby, when the door is in said first position, the hinge mechanism is not visible from a position in front of the appliance. Preferably, the hinge is so shaped and dimensioned whereby, in use, the extent of protrusion of the door laterally beyond said one side when the door is in said second position is less than or equal to that when the door is in said first position.

According to another aspect of the invention, there is provided a domestic appliance for built-in or slot-in installation, comprising: a housing having at least two sides; a front door; a hinge mechanism, provided at or adjacent one of the sides, coupling the door to the housing and permitting relative movement thereof, wherein the door is movable between a first position, in which the door is closed, and a second position, in which the door is fully open; wherein the hinge mechanism is so shaped and dimensioned whereby, in use, the extent of protrusion of the door laterally beyond said one side when the door is in said second position is less than or equal to that when the door is in said first position. Preferably, the hinge mechanism is attached to the door and to the housing at points spaced apart from the vertical extremities thereof, whereby, when the door is in said first position, the hinge mechanism is not visible from a position in front of the appliance.

Preferably, the hinge mechanism is so shaped and dimensioned such that, during movement of the door between said first position and said second position, the door moves laterally outwards then inwards, whereby the extent of protrusion of the door laterally beyond said one side is temporarily greater, by a small distance, than that when the door is in said first position. Preferably, the small distance is up to 3 mm, and more preferably 2-3 mm.

The hinge mechanism may be shaped and arranged whereby double movement, for example both rotational and translational movement, of the door relative to the housing is facilitated during movement between said first position and said second position.

Preferably, the hinge mechanism comprises, at least each of the top and bottom of the housing: a first hinge member, fixedly attached to the door and having a primary slot defined therein. Preferably, the first hinge member is spaced apart from both the top and bottom of the door.

Preferably, the hinge mechanism comprises, at least each of the top and bottom of the housing: a second hinge member, fixedly attached to the housing and having a secondary slot defined therein. Preferably, the second hinge member is spaced apart from both the top and bottom of the housing.

Preferably, the hinge mechanism further comprises, at least each of the top and bottom of the housing: a pair of connecting members, each connecting member coupling the first and second hinge members together via a respective slot, wherein each slot permits movement of a different type, of the first hinge member relative to the second hinge member.

Preferably, the primary slot comprises a relatively elongate slot and the secondary slot comprises a relatively short slot, or the primary slot comprises a relatively short slot and the secondary slot comprises a relatively elongate slot. Preferably, wherein the elongate slot is generally arcuate or generally curvilinear, thereby facilitating substantially rotational movement of the door relative to the housing during movement between said first position and said second position. Preferably, wherein the short slot extends in a linear manner, thereby facilitating substantially linear translational movement of the door relative to the housing during movement between said first position and said second position. Preferably, the short slot extends in a direction at an angle ("slot angle") to the line joining the endpoints of the elongate slot, the angle being for example approx. 45 degrees. However, this is one example of a possible configuration; the arrangement may be such that the aforementioned slot angle is up to 90 degrees or up to 180 degrees.

Suitably, each of the hinge members is in the form of a plate, for example made of steel. However, it will be appreciated by skilled persons that many alternative materials may be used, including many metals, subject to stress tolerance requirements. Alternatively, the hinge members may be in the form of blocks rather than plates, and/or may be a plastic moulded part.

The primary slot, the secondary slot, or both may have provided on the internal surface thereof a raised portion extending along the length of the slot, for engagement with a corresponding recessed shape in a respective coupling member. Alternatively, the slots may have flat inner surfaces.

The connecting member may comprise pins, nuts and bolts or. However, it will be appreciated by skilled persons that many alternative fixing means may be used.

The door may include a foremost, generally rectangular, glass plate; wherein the furthest lateral extent of the door is defined by the edge of the glass plate and the front facing surface of the glass plate when the door is in said first and second positions, respectively. Alternatively, the plate may be formed of perspex, PMMA, or some other suitable material with similar properties to the aforementioned materials. Alternatively, the plate may be wholly or partially made of metal, e.g. stainless steel or aluminium.

In an alternative configuration, instead of being provided at or adjacent one of the sides of the housing, the hinge mechanism is provided at or adjacent the top or bottom of the housing.

Suitably, the domestic appliance is a microwave oven. However, it will be appreciated by skilled persons that the appliance may take many alternative forms, which devices may be ovens incorporating one or more of the following cooking techniques: convection, microwave, steam, grill, and so forth. Alternatively, the appliance is a fridge, freezer, or other domestic appliance with a door.

Using techniques according to the invention, appliances such as microwave ovens can be flush fitted into rectangular apertures such as found in fitted kitchen furnishing, leaving no problematic unsightly gaps at the sides or elsewhere.

The invention enables the appliance to define the same rectangular profile or spatial requirement irrespective of whether the door is open or closed.

Thus the invention enhances the built-in or "slot-in" mounting of domestic appliances.

Figure 3:
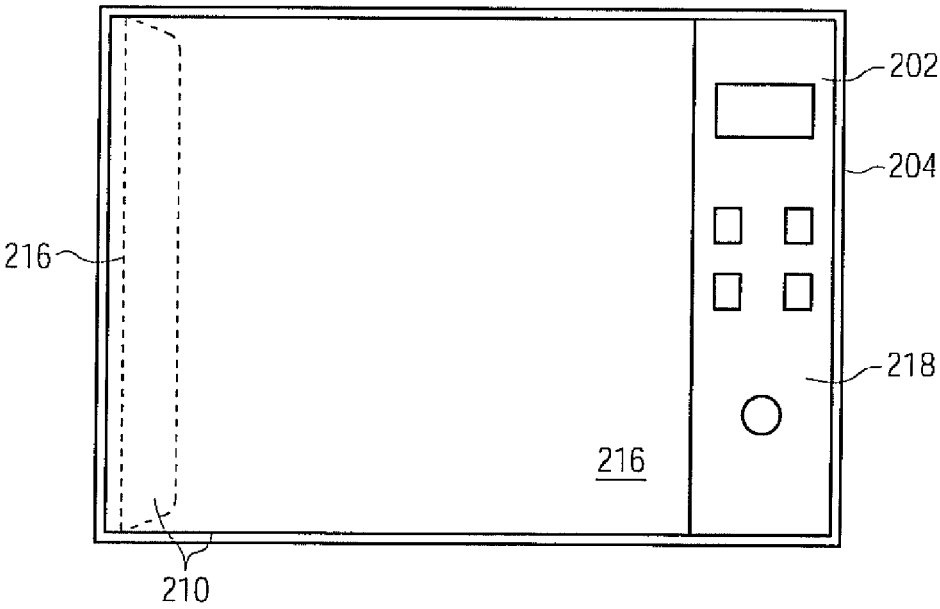
FIG. 3 shows the mounting of a microwave oven in a kitchen compartment, using techniques according to an embodiment of the invention.
Figure 4A:
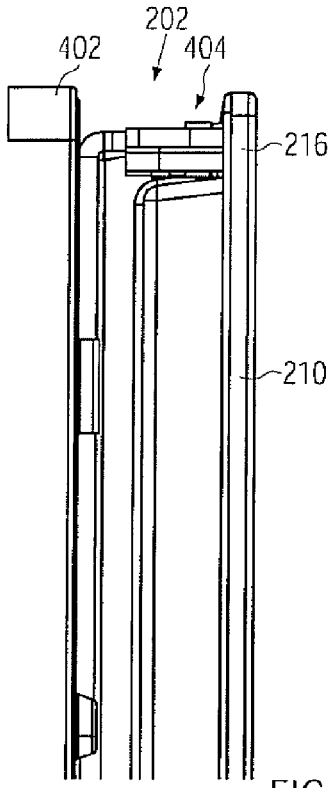
FIG. 4 shows partial views of the hinge mechanism employed in accordance with embodiments of the present invention, (a) of the top from the left side of the oven, (b) a front perspective view, (c) a first hinge member attached to the door, (d) a second hinge member attached to the housing (e) an exploded view of the two hinge members, and (f) a cross-section though a slot in a hinge member.
Figure 4B:
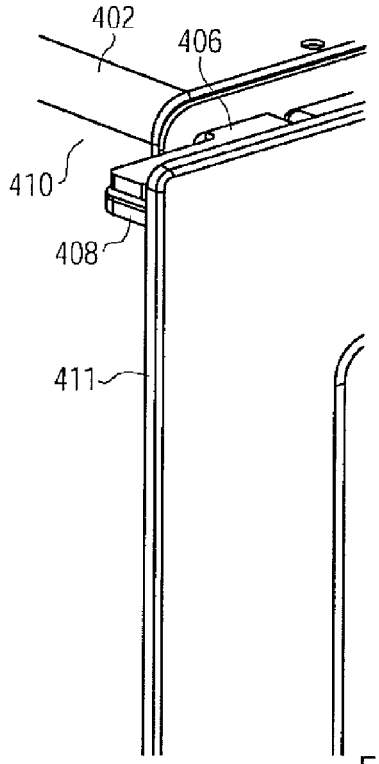
Figure 4C:
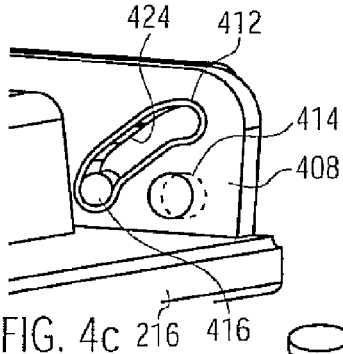
Figure 4D:
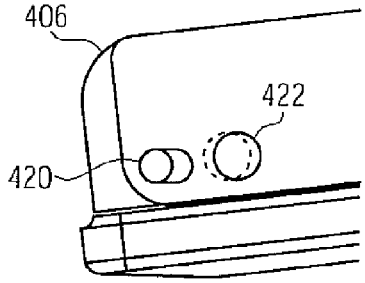
Figure 4E:
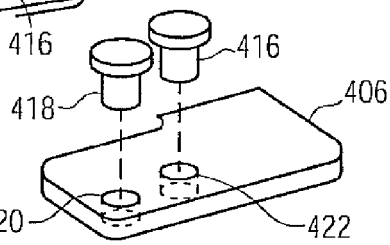
Figure 4F:
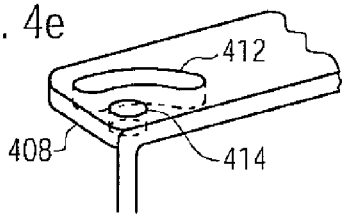
Figure 4F:
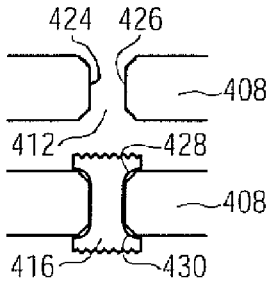
Figure 5A:
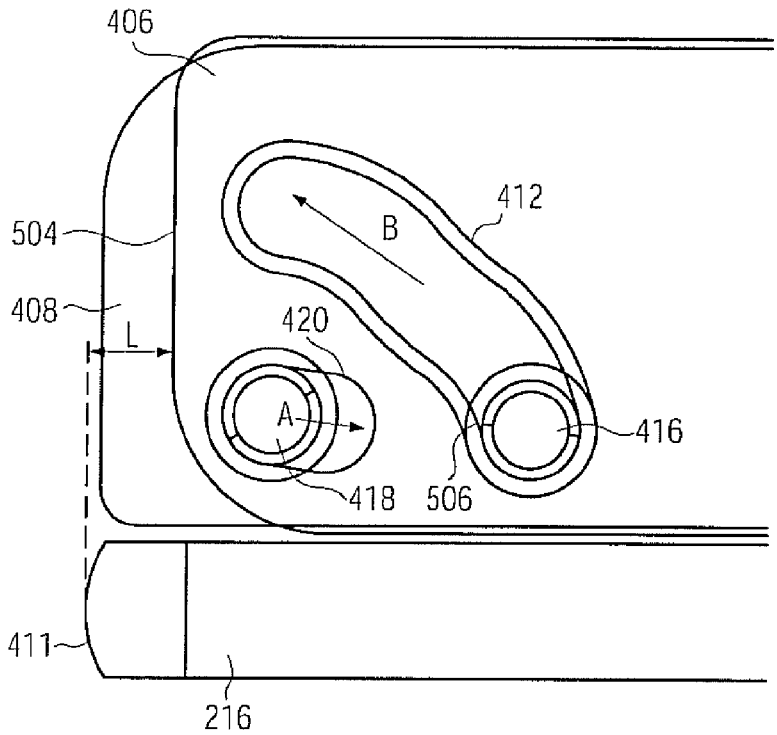
FIG. 5 shows a partial plan view of the upper part of the hinge mechanism, with the door (a) closed, (b) 20 degrees open, (c) 50 degrees open and (d) 90 degrees open.
Figure 5B:
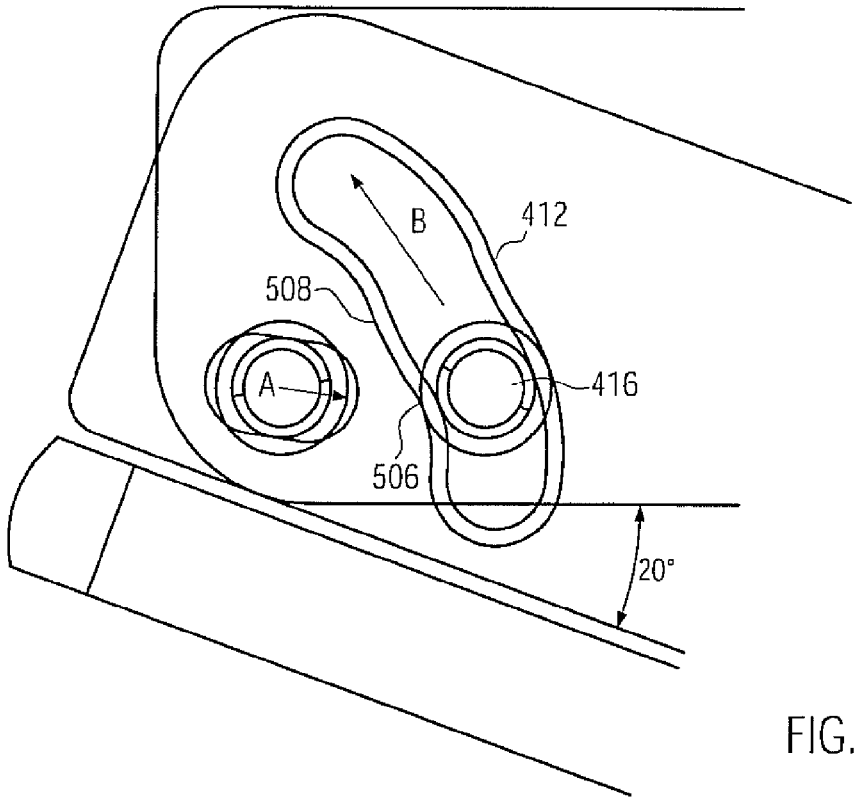
Figure 5C:
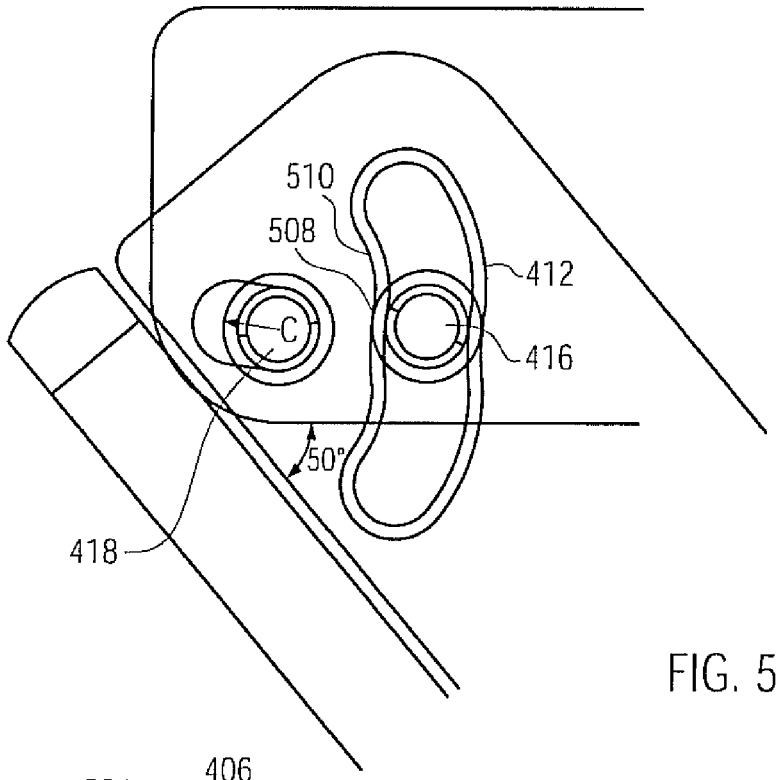
Figure 5D:
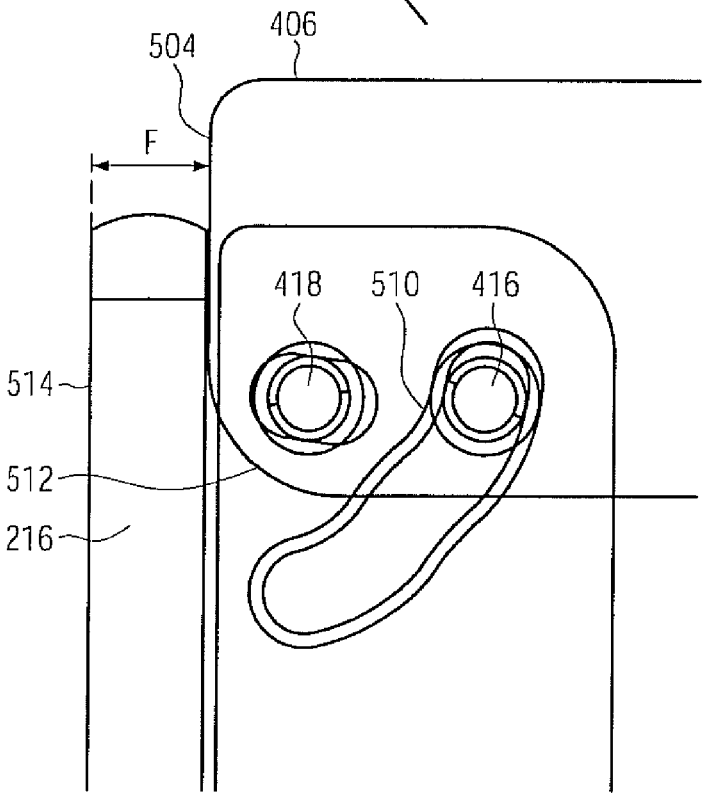

FIG. 3 shows the mounting of a microwave oven 202 in a kitchen compartment 204 of the built-in kitchen type, using techniques according to an embodiment of the invention that will be described in more detail hereinafter. The position of the oven door 210 is shown in solid lines for the closed position and dotted lines for the door open. The door 210 includes a glass front plate 216. (In accordance with conventional design schemes, there is typically a requirement to provide an oven engineered with an entire glass front (excluding the control/display panel 218).)

In each position, it can be seen that the oven 202 fits flush within the compartment 203, with minimal or no spacing between the sides, and upper and lower surfaces of the oven on the one hand, and the sides of the compartment 204 on the other. In particular, in each of the positions of the door 210, the furthermost lateral (i.e. leftmost) extent of the door 210 (and therefore the oven 202, is the same, such that no gap or spacing is required on the leftmost side between the oven 202 and the side of the compartment 203.

FIG. 4 shows partial views of the hinge mechanism employed in accordance with embodiments of the present invention. FIG. 4 (*a*) is a view of the top from the left side of the oven 202, showing the attachment of the door 210 to the housing 402 of the oven 202. Included is a hinge mechanism (only the top part of which is shown), generally designated 404. As discussed earlier in relation to FIG. 3, the door 210 in this embodiment includes a glass front plate 216.

FIG. 4 (*b*) is a front perspective view of the top from the left side of the oven 202. As can be seen, the top part of the hinge mechanism 404 includes a first hinge member (or bracket) 406 that is fixedly attached to the housing 402 by means of screws or bolts (not shown), and a second hinge member (or bracket) 408 that is fixedly attached to the door 210 by means of screws or bolts (not shown). The lower part of the hinge mechanism has a corresponding construction, and is omitted, for brevity.

The door in FIGS. 4 (*a*) and (*b*) is shown in the closed position. The left side of the housing 402 is indicated at 410, and extending beyond that laterally are the first and second hinge members 406, 408, and, to the greatest extent, the edge 411 of the glass plate 216 of the door 210, as be discussed in more detail hereinafter.

FIG. 4 (*c*) shows in more detail a first hinge member 406 attached to the door, FIG. 4 (*d*) shows a second hinge member 408 attached to the housing 402 and FIG. 4 (*e*) shows an exploded view of the two hinge members. FIG. 4 (*c*) is view from below of the second hinge member 408, which includes an arcuate slot 412 and a second circular hole 414. When assembled, the arcuate slot 412 receives a pin or bolt 416, and second circular hole 414 receives pin or bolt 418 (see FIG. 4(*e*)).

As seen in FIG. 4(*d*), which shows the first hinge member 406, from above, the latter includes a relatively short slot 420 and a first circular hole 422. When assembled, the short slot 420 receives a pin or bolt 418, and first circular hole 422 receives pin or bolt 416 (see FIG. 4(*e*)).

It will be seen that the short slot 420 facilitates generally lateral movement of the pin 418 (and therefore the second hinge member 408 and door 210 attached thereto), and the arcuate slot 412 facilitates generally arcuate or curvilinear movement of the pin 416 (and therefore of the second hinge member 408 in relation to the first hinge plate 406).

In the illustrated embodiment, the pins 416, 418 and the hinge members 406, 408 are separate components. However, in a preferred form, the pin 418 is manufactured integrally (i.e. as a projection) with hinge member 408 and/or the pin 416 is manufactured integral with hinge member 406, or conversely. In yet a further alternative, both pins (projections) may be manufactured integral with either hinge member 406 or hinge member 408.

FIG. 4 (*f*) shows a partial cross-section though a slot in a hinge member (e.g. arcuate slot 412 in hinge member 408); and as illustrates also in FIG. 4(*c*), the internal surfaces of the slot 412, along which the pin 416 travels, may be provided with raised portions 424, 426 along the length of the slot 412. These raised portions 424, 426 engage with corresponding shoulders 428, 430 of the pin 416, thereby retaining the latter in a stable orientation during sliding movement of the hinge members 406, 408. Alternatively or additionally, the slot 420 may be provided with raised portions (not shown) on its internal surfaces, for cooperation with corresponding shoulders (not shown) on the pin 418.

FIG. 5 shows a partial plan view of the upper part of the hinge mechanism, with the door (a) closed, (b) 20 degrees open, (c) 50 degrees open and (d) 90 degrees open. FIG. 5 therefore illustrates the relative movement, and the positions of the components at various points between the closed position of the door 210 (FIG. 5(*a*)) and the open position of the door (FIG. 5(*d*)). During the motion between the two positions, the pin 418 moves within the short slot 420 in the direction of arrow A, and the pin 416 moves within the arcuate slot 412 in the direction of arrow B.

Referring to FIG. 5(*a*), the furthest lateral part is the edge 411 of the glass plate 216: and the extent that this protrudes beyond the edge 504 of the first hinge member 406 is indicated as L.

In the movement between FIGS. 5(*a*) and 5(*b*), the motion of the pin 416 in the arcuate slot 412 is generally curved, around bend 506; thereafter (between FIGS. 5(*b*) and 5(*c*)), the motion is generally straighter, along section 508 of the arcuate slot 412.

Between FIGS. 5(*c*) and (*d*), i.e. from about 50 degrees to about 90 degrees open, the pin 416 reaches the end of the section 508, and again traverses a bend 510 until the final position is reached. It will be noted that in FIG. 5(*c*), i.e. in the straight section 508, the other pin 418 is traveling in the short slot 420 in direction C, which is approximately 180 degrees opposite to the direction A in which it was earlier traveling.

The overall effect is that the glass plate 216, which extends upwardly above both hinge members 406, 408, smoothly moves around the curved corner section 512 of the first hinge member 406, until it reaches it's final position (FIG. 5(*d*)). Also, the extent F that the most lateral part (the surface 514 of the glass plate 216) protrudes beyond the edge 504 of the first hinge member 406 is equal to or less than the distance L in the closed position (FIG. 5(*a*)), thus facilitation flush fitting of the microwave oven within a rectangular compartment (See FIG. 3)) of near identical dimensions to the peripheral dimensions of the oven 202.

Although particular embodiment(s) of the present invention have been shown and described, it will be understood that it is not intended to limit the invention to the preferred embodiment(s) and it will be obvious to those skilled in the art that various changes and modifications may be made without departing from the spirit and scope of the present invention. Thus, the invention is intended to cover alternatives, modifications, and equivalents, which may be included within the spirit and scope of the invention as defined by the claims.

All publications, patents, and patent applications cited herein are hereby incorporated by reference in their entirety for all purposes.

What is claimed is:

1. A domestic appliance for built-in or slot-in installation, comprising:

a housing having at least two sides;

a front door;

a hinge mechanism, provided at or adjacent one of the sides, coupling the door to the housing and permitting relative movement thereof, wherein the door is movable between a first position, in which the door is closed, and a second position, in which the door is fully open;

wherein the hinge mechanism is attached to the door and to the housing at points spaced apart from the vertical extremities thereof, whereby, when the door is in said first position, the hinge mechanism is not visible from a position in front of the appliance; and wherein the hinge mechanism is so shaped and dimensioned whereby, in use, the door protrudes laterally beyond said one side in said first position, such that the extent of protrusion of the door laterally beyond said one side when the door is in said second position is less than or equal to that when the door is in said first position.

2. The appliance of claim 1, wherein the hinge mechanism is so shaped and dimensioned such that, during movement of the door between said first position and said second position, a lateral edge of the door moves laterally outwards then inwards, whereby the extent of protrusion of the door laterally beyond said one side is temporarily greater, by a small distance, than that when the door is in said first position.

3. A domestic appliance for built-in or slot-in installation, comprising:

a housing having at least two sides;

a front door;

a hinge mechanism, provided at or adjacent one of the sides, coupling the door to the housing and permitting relative movement thereof, wherein the door is movable between a first position, in which the door is closed, and second position, in which the door is fully open;

wherein the hinge mechanism is so shaped and dimensioned whereby, in use, the door protrudes laterally beyond said one side in said first position, such that the extent of protrusion of the door laterally beyond said one side when the door is in said second position is less than or equal to that when the door is in said first position; and wherein the hinge mechanism is so shaped and dimensioned such that, during movement of the door between said first position and said second position, a lateral edge of the door moves laterally outwards then inwards, whereby the extent of protrusion of the door laterally beyond said one side is temporarily greater, by a small distance, than that when the door is in said first position.

4. The appliance of claim 3, wherein the hinge mechanism is attached to the door and to the housing at points spaced apart from the vertical extremities thereof, whereby, when the door is in said first position, the hinge mechanism is not visible from a position in front of the appliance.

5. The appliance of claim 3, wherein, said small distance is up to about 3 mm.

6. The appliance of claim 3, wherein the hinge mechanism is shaped and arranged whereby double movement of the door relative to the housing is facilitated during movement between said first position and said second position.

7. The appliance of claim 1, wherein the hinge mechanism comprises a first hinge member at each of the top and bottom of the housing, the first hinge member fixedly attached to the door and having a primary slot defined therein.

8. The appliance of claim 7, wherein the first hinge member is spaced apart from both the top and bottom of the door.

9. The appliance of claim 7, wherein the hinge mechanism comprises a second hinge member at each of the top and bottom of the housing, the second hinge member fixedly attached to the housing and having a secondary slot defined therein.

10. The appliance of claim 9, wherein the second hinge member is spaced apart from both the top and bottom of the housing.

11. The appliance of claim 7, wherein the hinge mechanism further comprises a pair of connecting members at each of the top and bottom of the housing, each connecting member coupling the first and second hinge members together via a respective slot, wherein each slot permits movement of a different type, of the first hinge member relative to the second hinge member.

12. The appliance of claim 11, wherein, the primary slot comprises an elongate slot and the second slot comprises a short slot, or the primary slot comprises a short slot and the secondary slot comprises an elongate slot.

13. The appliance of claim 12, wherein the elongate slot is generally arcuate or generally curvilinear, thereby facilitating substantially rotational movement of the door relative to the housing during movement between said first position and second position.

14. The appliance of claim 12, wherein the short slot extends in a linear manner, thereby facilitating substantially linear translational movement of the door relative to the housing during movement between said first position and said second position.

15. The appliance of claim 12, wherein the short slot extends in a direction at an angle to the line joining the endpoints of the elongate slot.

16. The appliance of claim 7, wherein each of the hinge members is in the form of a plate.

17. The appliance of claim 7, wherein the primary slot, the secondary slot, or both have provided on the internal surface thereof a raised portion extending along the length of the slot, for engagement with a corresponding recessed shaped in a respective coupling member.

18. The appliance of claim 11, wherein ones of the pair of connecting members comprise pins, nuts and bolts.

19. The appliance of claim 1, wherein the front door includes a foremost, generally rectangular, glass plate; wherein the furthest lateral extent of the front door is defined by the edge of the glass plate and the front facing surface of the glass plate when the front door is in said first and second positions, respectively.

20. The appliance of claim 1, wherein, instead of being provided at or adjacent one of the sides of the housing, the hinge mechanism is provided at or adjacent the top or bottom of the housing.

21. The appliance of claim 1 comprises at least one of an oven, a microwave oven, a fridge and a freezer.

22. The appliance of claim 5, wherein said small distance is in a range of about 2 mm to about 3 mm.

23. The appliance of claim 6, wherein the double movement comprises a rotational movement and a translational movement.

24. The appliance of claim 15, wherein the angle is about 45 degrees.

25. The appliance of claim 16, wherein the plate comprises steel.

26. A domestic appliance for built-in or slot-in installation, comprising:

a housing having at least two sides;

a front door a hinge mechanism, provided at or adjacent one of the sides, coupling the door to the housing and permitting relative movement thereof, wherein the door is movable between a first position, in which the door is closed, and a second position, in which the door is fully open;

wherein the hinge mechanism is so shaped and dimensioned whereby, in use, the door protrudes laterally beyond said one side in said first position, such that the extent of protrusion of the door laterally beyond said one side when the door is in said second position is less than or equal to that when the door is in said first position; and wherein, the door includes a foremost, generally rectangular, glass plate; wherein the further lateral extent of the door is defined by the edge of the glass plate and the front facing surface of the glass plate when the door is in said first and second positions, respectively.

27. A domestic appliance for built-in or slot-in installation, comprising:

a housing having at least two sides;

a front door; and a hinge mechanism, provided at or adjacent one of the sides, coupling the door to the housing and permitting relative movement thereof, wherein the door is movable between a first position, in which the door is closed, and a second position, in which the door is fully open, wherein the hinge mechanism is so shaped and dimensioned whereby, in use, the door protrudes laterally beyond said one side in said first position, such that the extent of protrusion of the door laterally beyond said one side when the door is in said second position is less than or equal to that when the door is in said first position, wherein, in use, a primary slot within the hinge mechanism limits the angular movement of the front door between said first position and said second position, and wherein the hinge mechanism includes a secondary slot extending generally parallel to the plane in which the door lies when in the first position whereby, in use, the door moves laterally inwardly as it moves out of the first position.

* * * * *